US007900921B1

(12) United States Patent
Palmer et al.

(10) Patent No.: US 7,900,921 B1
(45) Date of Patent: Mar. 8, 2011

(54) SYSTEM FOR TRACKING MOTION OF GAME ARTICLES

(75) Inventors: William Palmer, Rescue, CA (US); Stephen Palmer, Cameron Park, CA (US); Robert Palmer, Cameron Park, CA (US)

(73) Assignee: Sierra Innotek, Inc., Cameron Park, CA (US)

( * ) Notice: Subject to any disclaimer, the term of this patent is extended or adjusted under 35 U.S.C. 154(b) by 613 days.

(21) Appl. No.: 11/977,235

(22) Filed: Oct. 24, 2007

Related U.S. Application Data

(60) Provisional application No. 60/856,870, filed on Oct. 28, 2006.

(51) Int. Cl.
*A63B 71/04* (2006.01)

(52) U.S. Cl. ..... 273/126 A; 473/588; 273/108; 273/118 A

(58) Field of Classification Search ..... 273/108, 273/118 R, 118 A, 119 R, 119 A, 120 R, 273/120 A, 121 R, 121 A, 122 R, 122 A, 273/123 R, 123 A, 124 R, 124 A, 125 R, 273/125 A, 126 R, 126 A; 473/588, 589
See application file for complete search history.

(56) References Cited

U.S. PATENT DOCUMENTS

| | | | | | |
|---|---|---|---|---|---|
| 3,102,727 | A | * | 9/1963 | Rice | 473/570 |
| 3,773,325 | A | | 11/1973 | Crossman et al. | |
| 4,183,536 | A | * | 1/1980 | Platt | 473/570 |
| 4,846,475 | A | * | 7/1989 | Newcomb et al. | 473/570 |
| 4,968,036 | A | * | 11/1990 | Von Der Mark | 473/570 |
| 5,564,698 | A | | 10/1996 | Honey et al. | |
| 5,912,700 | A | * | 6/1999 | Honey et al. | 348/157 |
| 5,941,778 | A | * | 8/1999 | Vasalech | 473/1 |
| 5,953,077 | A | * | 9/1999 | Honey et al. | 348/589 |
| 6,048,280 | A | | 4/2000 | Palmer et al. | |
| 6,126,561 | A | * | 10/2000 | Mark | 473/588 |
| 6,234,476 | B1 | | 5/2001 | Yamashita et al. | |
| 6,645,097 | B2 | * | 11/2003 | Samuel et al. | 473/588 |
| 2004/0220001 | A1 | * | 11/2004 | Oister et al. | 473/570 |
| 2007/0275801 | A1 | * | 11/2007 | Proulx et al. | 473/588 |

OTHER PUBLICATIONS

Promotional sheet advertising HotFlash II Air Hockey Game.
Print-out from web site for Geo Safari Light Writer.

* cited by examiner

*Primary Examiner* — Raleigh W. Chiu
(74) *Attorney, Agent, or Firm* — Thomas R. Lampe

(57) ABSTRACT

A method and apparatus for displaying the track of a game article moving on a play surface, the game article directing energy to said play surface to energize energy reactive material and provide a visually observable track display.

20 Claims, 6 Drawing Sheets

SYSTEM FOR TRACKING MOTION OF GAME ARTICLES

This application is based on and claims the benefit of U.S. provisional patent application No. 60/856,870 filed Oct. 28, 2006.

TECHNICAL FIELD

This invention relates to a method and apparatus for altering the appearance of the play surfaces beneath game articles and thereby creating a record of their path. The embodiment disclosed herein has particular application to games such as table top hockey, billiards and the like wherein the movement of an article relative to a play surface causes the appearance of the surface to be altered thereby rendering a track of the motion of the moving article.

BACKGROUND ART

Many games exist where a movable article such as a ball or puck is caused to move across a play surface. For example, billiards or pocket pool employs smooth, round balls which are maneuvered into traps called pockets to score. Similarly, hockey, employs small pucks which are urged into goals by the players. The game of hockey is typically played on a smooth ice surface so that the puck will glide speedily towards the goals when urged in that direction by a player. Hockey can also be played on paved surfaces with specially designed pucks for that purpose. In situations where space or weather does not permit large outdoor games, the game of hockey can also be played indoors on a smooth surface. On a smaller scale, hockey can even be played on a table top. Typically, table top hockey games employ a special playing surface which creates an air cushion beneath the puck, permitting it to glide smoothly and quickly towards the goal. This air cushion may be generated by placing a source of air or other gas inside the puck and permitting it to escape from beneath the puck so that it will levitate the puck slightly above the game surface. More often, the air cushion is created by utilizing a play surface which is perforated with a plurality of small holes. A plenum is hydraulically coupled to the underside of the surface and an air source is provided. Air is permitted to flow through the holes in the playing surface whereupon it creates a cushion of air upon which the puck is supported. Because the friction between the puck and the playing surface is very low, the puck will respond quickly to the application of force by mallets or other striking means.

While the game is popular, there is always a need to further enhance the action and excitement of the game in order that it remain competitive with other games and sources of entertainment. In both the arcade and home environment, several attempts have been made to further enhance the excitement of these games. Automatic scoring systems which display the game score by electronic means have been used in an attempt to make the game progress more quickly and eliminate the need for manual score keeping. Sometimes colorful graphics are applied to the game articles and a "black light" may be used to cause them to "glow." A commercially available table top hockey game, "the Hot Flash II" made available by Valley Dynamo, utilizes a table having a UV coating that allows the playfield, rails and graphics to glow under most lighting conditions. While the illumination of these articles adds interest, it is only superficial and does nothing to enhance the excitement of the game play action. Because play action in hockey type games is typically very fast, it is often difficult to determine the exact course that has been traversed by the puck. For televised, professional hockey games, some networks have developed an electronic means of "painting" the path of the puck. In this system, a computer is employed to keep track of the puck. The computer then generates a track of the path of the puck which is electronically overlaid on the live action video graphic of the game. This allows viewers to more easily observe the position of the puck and track its whereabouts. If a process could be developed which would permit the action of a game article such as a puck to be tracked and displayed which did not require expensive and complicated electronic equipment it would be of great value. Furthermore, if the system was highly economical, it could also find application in small scale games such as arcade and home type hockey and billiard games and the like. Still further, if a means could be devices which would permit the game players to have a temporary record of the motion of the game articles relative to each other and the goals, it would be useful as a teaching tool and a means to enhance strategies of play.

It is known to use light to photoluminesce articles of various types. A commercially available product called the Geo Safari Light Writer by Educational Insights includes a photoluminescent tablet and light emitting drawing pen. The following U.S. Pat. Nos. are of general interest: 6,048,280, 5,564,698, 3,773,325, 4,846,475 and 6,234,476. These patents do not disclose or suggest the invention disclosed or claimed herein.

DISCLOSURE OF INVENTION

Figure 1:
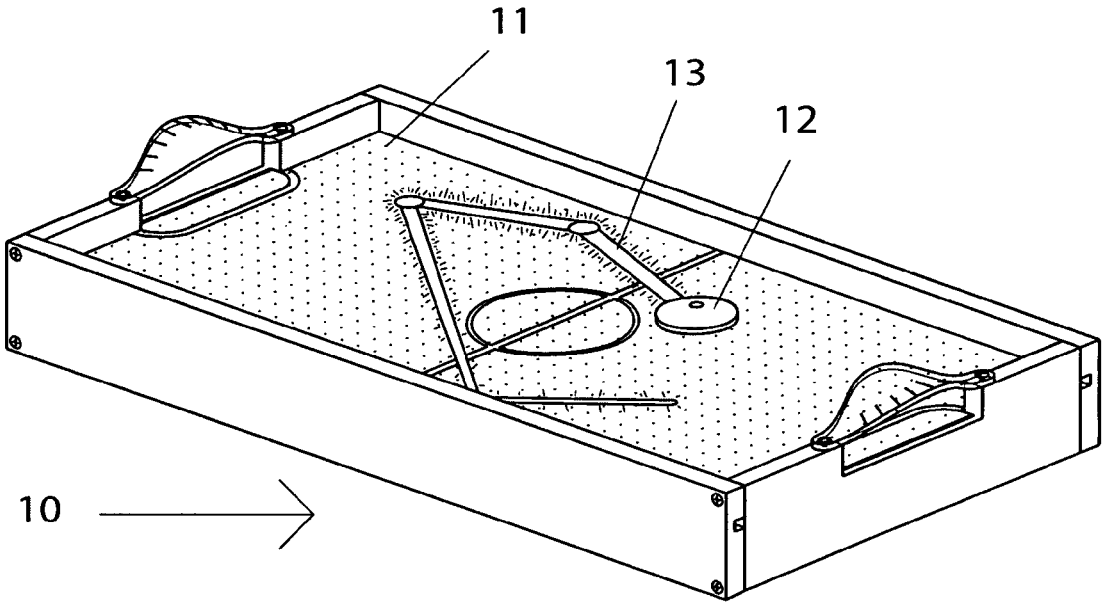
FIG. 1 shows a table type game in which the appearance of the play surface is being altered by an energy emitting puck to produce a continuous reactive trace.

The apparatus of the present invention provides a means whereby a game article such as a puck, changes the appearance of a play surface beneath the puck. The apparatus means may include an article such as a puck and a special surface such as a game surface which is at least partially comprised of photoluminescent or photochromic, or other similarly reactive material. A light source or other activation means within the article is provided to alter the appearance of the surface beneath the article. As the puck passes over the play surface, energy from the puck which is transmitted to the play surface causes the appearance of the play surface to be altered. In one embodiment, the puck comprises a light emitting source, preferably an ultraviolet LED which illuminates the reactive play surface as the puck passes over it. As ultraviolet radiation from the puck is absorbed by the reactive play surface, the appearance of the play surface is altered. If the play surface is photoluminescent, a glowing track is generated as the puck passes over it. If a photochromic play surface is employed, the color of the surface is altered as the puck glides over it. Because the light source is attached to the puck, it paints a track which precisely follows the movement of the puck even if the puck travels in a zigzag pattern. The light source may be centered in the puck so that the track represents the path of the motion of the center of the puck in which case, the puck paints straight lines more or less until the puck is acted upon by force from a striker or side wall. If the light source is positioned off center in the puck, any spinning action of the puck will produce spiral loop patterns on the play surface. The nature of the energy source may be such that it paints any width of track as may be desired. Additionally, a control means may be employed to cause the energy source, such as an ultraviolet LED, to be switched on and off as a predetermined rate so that as it passes over the reactive play surface it paints a series of "dots" or "dashes." Furthermore, the puck may contain a plurality of energy emitting devices which are switched on and off or otherwise controlled so as to generate a recognizable pattern of dots such as letters, words of other graphics as the puck alters the play surface. The energy source may also employ a "mask" so that at least a portion of the energy is blocked or redirected in a manner that permits a predetermined pattern to be written on the play surface. In the case where it is desirable to generate text or graphics, the puck may be equipped with a means to determine the direction and relative motion of the puck so that the text may be properly written to the play surface and is not inverted or otherwise significantly distorted. It is anticipated that graphics including, but not limited to, the game score, players names or other messages may be written by the puck on the playing surface. The duration of visibility of the message or other indicia written on the playing surface may be controlled by the level of the energy emitted from the puck and or by the exact nature of the reactive material. In the case of photoluminescent materials such as ZnS hex:Cu, the afterglow of the trace can be bright enough to be visualized even in a moderately lighted room. In darkened environments, the glow trace is spectacular and persists for many minutes after activation. In the case of photochromic play surfaces, the color change which is caused by the energy emitting puck may also last several minutes, with the duration of the effect being determined by the level of exposure to the energy source and the exact nature of the reactive material. It is of course possible to combine the effects of photochromic and photoluminescent materials to realize the effects of both in a single play surface. The nature of the energy emitted by the puck is not limited to light but may also be of a magnetic field, or thermal nature. Further, the radiation may be of an ionizing nature such as radioactive emissions or x-rays. An "inverse" tracking system is anticipated whereby the reactive surface is first energized by an energy source and then later, de-energized by exposure to a second form of energy. An example of this employs a photoluminescent reactive surface such as one employing ZnS or other photoluminescent materials. An infrared light or other long wavelength light source such as visible red or orange is then employed to cause the energized surface to dump its energy. When this energy is dumped, the photoluminescent surface no longer glows and a dark trace will be produced as the puck with the second wavelength source passes over it. The process of "photo-stimulation" or "photo-quenching" is thereby employed to create an "inverse" graphic field.

The energy emitting puck or other article, may also be equipped with a means of sensing position on the play surface. This means may be internal to the puck such as a photo receiver or magnetic sensor, or, the sensing means may be external to the puck and transmitted to the puck as may be desired via audio, radio frequency or other forms of electromagnetic radiation. It is anticipated that the play surface may comprise a plurality of different reactive materials which produce different effects when activated. For example, a pattern of photochromic agents may be employed in such a manner as alternating stripes or dots which stripe or dot is capable of producing a unique effect as compared to similar stripes or dots of other photochromic agents. If a grid of repeating stripes of RED, GREEN and BLUE photochromic (or photoluminescent) agents were employed across the play surface, it would be possible to generate a color representation of any sequence desired simply by switching the energy emitting means in the puck on and off at the appropriate times as the puck passes over each colored stripe. Similar to the method used to produce color television pictures, the puck would paint a picture made up of pixels as it passed over the play surface. The patterns could be simple or complex. Since the decay rate of the reactive material can be very long, it is possible to paint a complete picture even though it may require many passes of the puck over the game surface in order to pass over all the desired regions to be altered. The patterns to be generated could come from a template or memory either within or external to the puck which controls the writing process as the puck passes over the game surface. Patterns may include licensed graphics such as team logos or messages offering items for sale or specials at the snack bar at an arcade. Additionally game play may include players attempting to guess the pattern as it is being written, with an award given to the first correct guesser.

Players may of course, manually control the position of the puck relative to the reactive surface thereby creating indicia of a hand-drawn nature. These indicia may include targets or boundary lines which are to be "hit" or avoided during subsequent game play.

Other features, advantages, and objects of the present invention will become apparent with reference to the following descriptions.

BEST MODE FOR CARRYING OUT THE INVENTION

Figure 2:
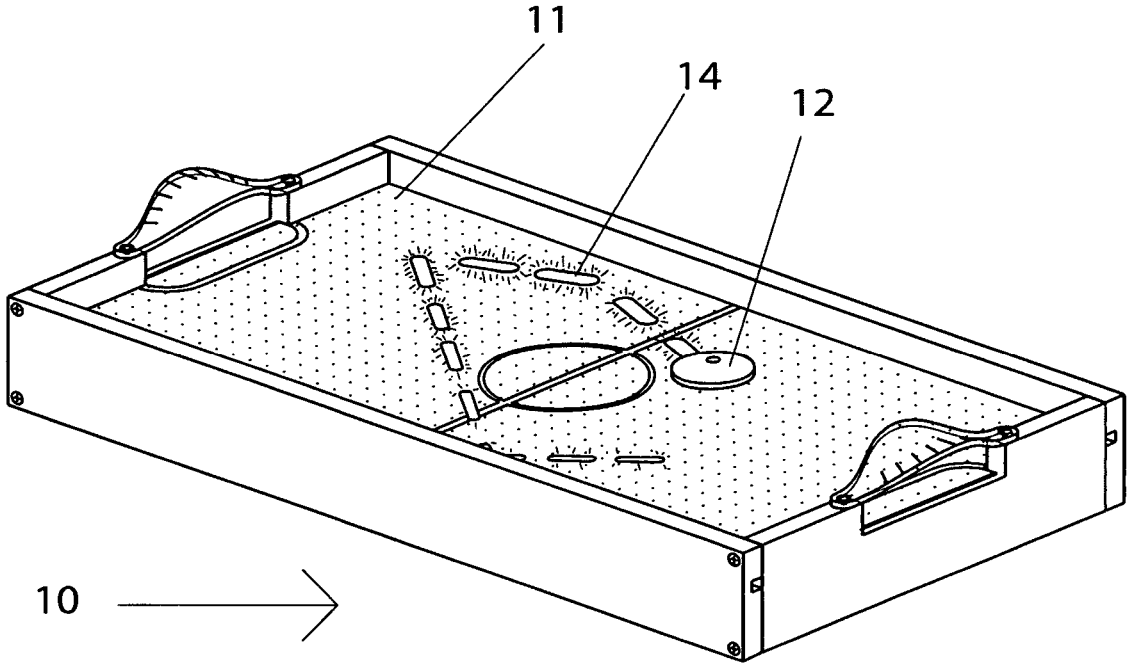
FIG. 2 shows a table type game in which the appearance of the play surface is being altered by an energy emitting puck to produce an intermittent reactive trace.
Figure 3:
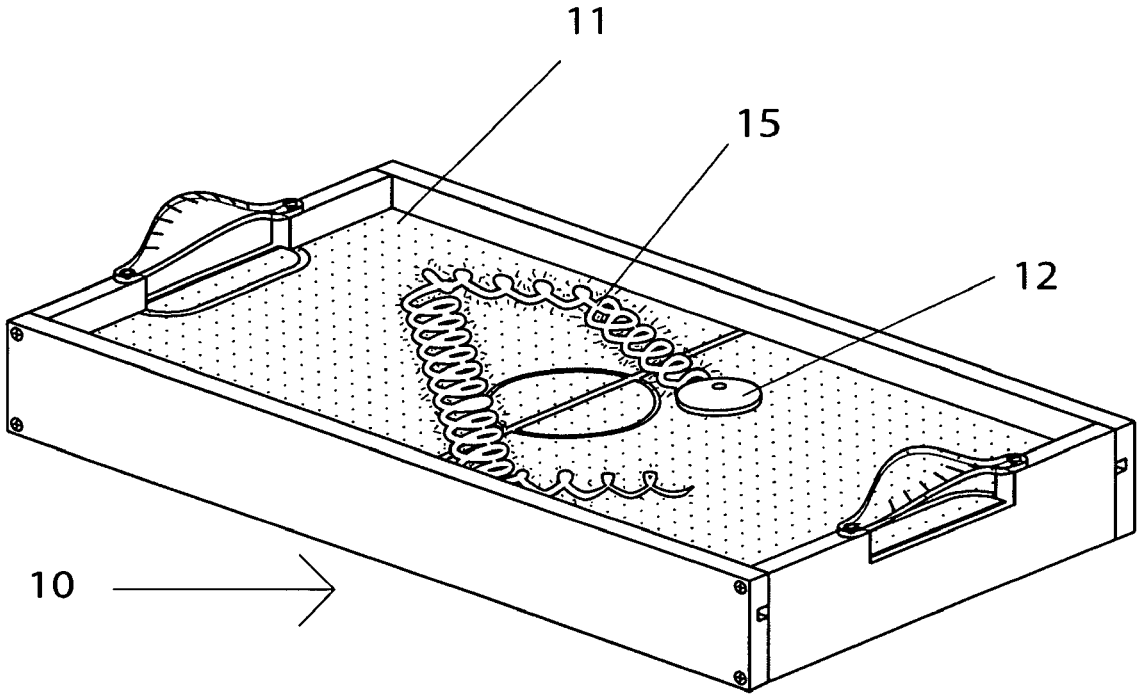
FIG. 3 shows a table type game in which the appearance of the play surface is being altered by an energy emitting puck to produce a nonlinear reactive trace.
Figure 4:
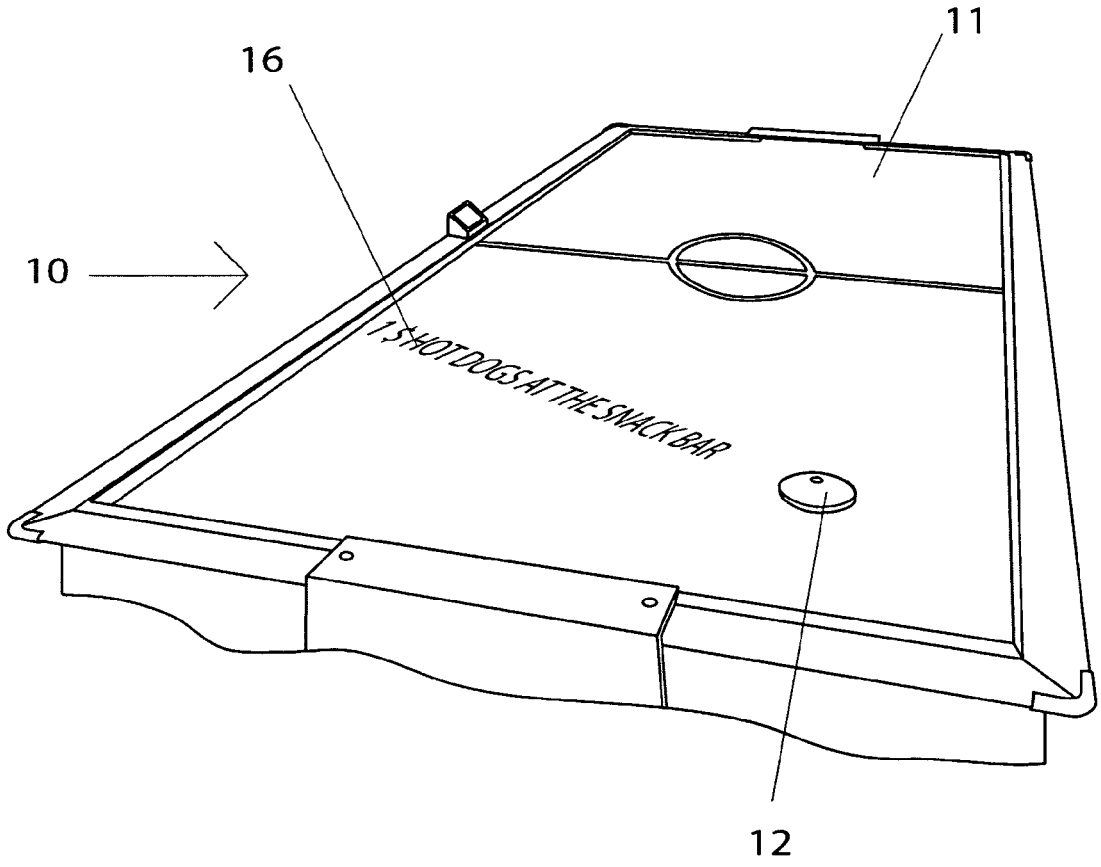
FIG. 4 shows a table type game in which the appearance of the play surface is being altered by an energy emitting puck to produce indicia.
Figure 5:
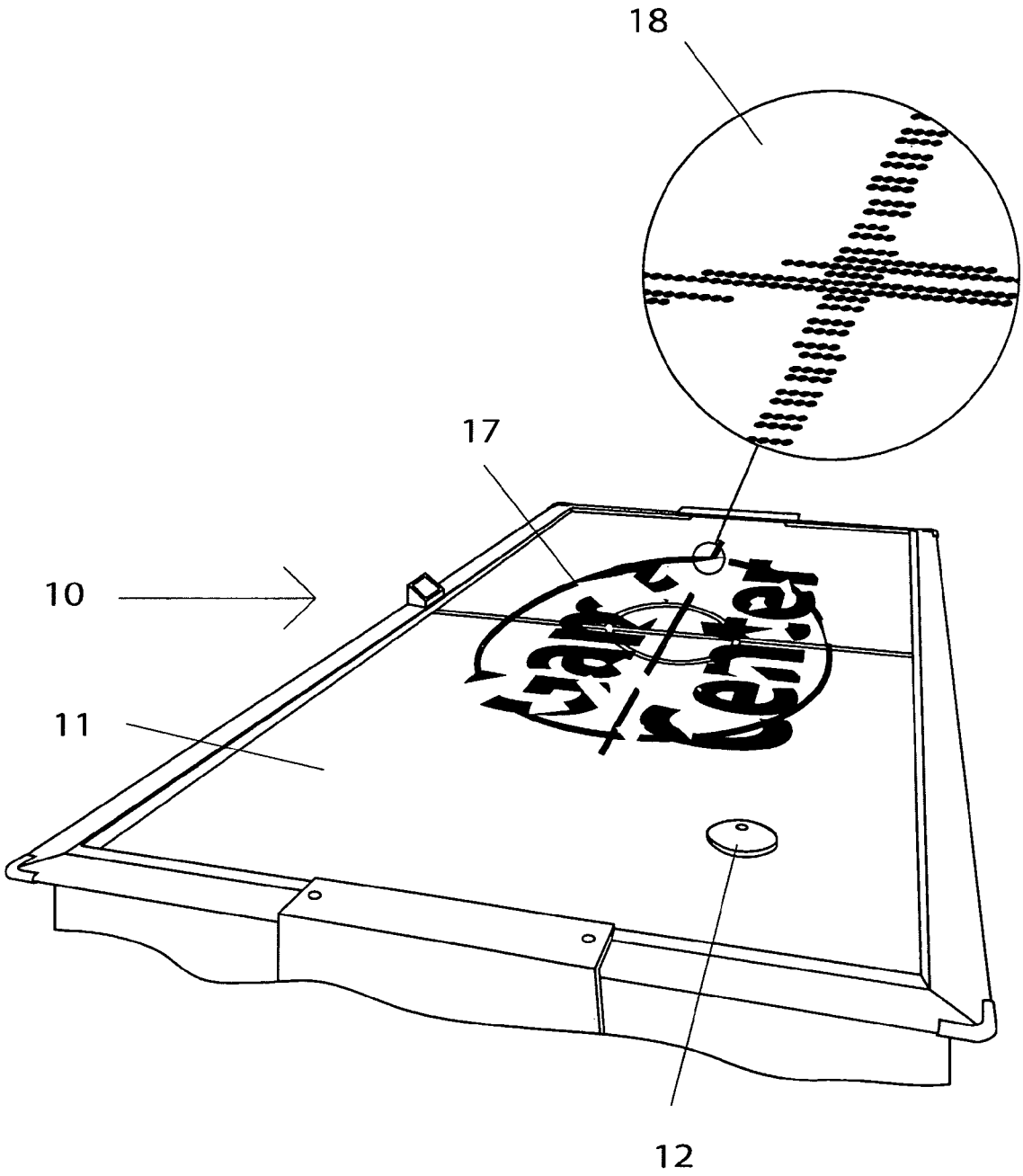
FIG. 5 shows a table type game in which the appearance of the play surface is being altered by an energy emitting puck which selectively energizes various multiple reactive elements.

As illustrated in FIG. 1, the instant invention 10 comprises a reactive surface 11, and an energy emitting game element 12. As the energy emitting game element 12 travels across reactive surface 11, energy such as ultraviolet light causes a change in the appearance of reactive surface 11. This change may manifest itself in the form of reemitted energy such as may be the case with photoluminescent materials. Similarly, the change in appearance may be in the form of a color change such as is evidenced by photo or thermochromic materials. Such appearance changing materials are known and are not claimed here. In the case of photo luminescent or photochromic materials, it is desirable to use an excitation energy source which is within the excitation band of the material. Often, this energy is of a high level such as light emitted by an ultraviolet LED or Xenon flash lamp. An energy emitting source 21 is situated in such a manner that energy emitted by this source can impact with reactive surface, 11. If the energy emitting source 21 is continuously operated as it passes over reactive surface 11, a continuous reactive trace 13 will be produced. It the energy emitted by energy emitting source 21 is of a discontinuous nature then an intermittent reactive trace 14 will be produced on reactive surface 11 as illustrated in FIG. 2. If energy emitting source 21 is positioned so that it is not coincident with the center of rotation of energy emitting game element 12 as shown by the dash line depiction of energy source 21 in FIG. 6, then a nonlinear reactive trace 15 may be produced as is illustrated in FIG. 3. It is anticipated that a plurality of modulated or otherwise controlled energy emitting sources 21 can be employed so that indicia 16 can be produced as illustrated in FIG. 4. Such indicia could be generated by a microcontroller and might display for example, current game score, player names or other messages to the players. The data to generate these messages or other graphics could be generated by the game itself or be relayed to the game from a remote location. An image comprised of multiple elements 17 may be produced by the selective excitation of a plurality of reactive sites or "pixels" as is illustrated in FIG. 5. The pixels may be arranged in a series of repeating dots, alternating stripes or various differing reactive materials or any other suitable scheme such as those employed in generating television images. One such scheme is illustrated in FIG. 5 employing circular pixels 18.

Figure 6:
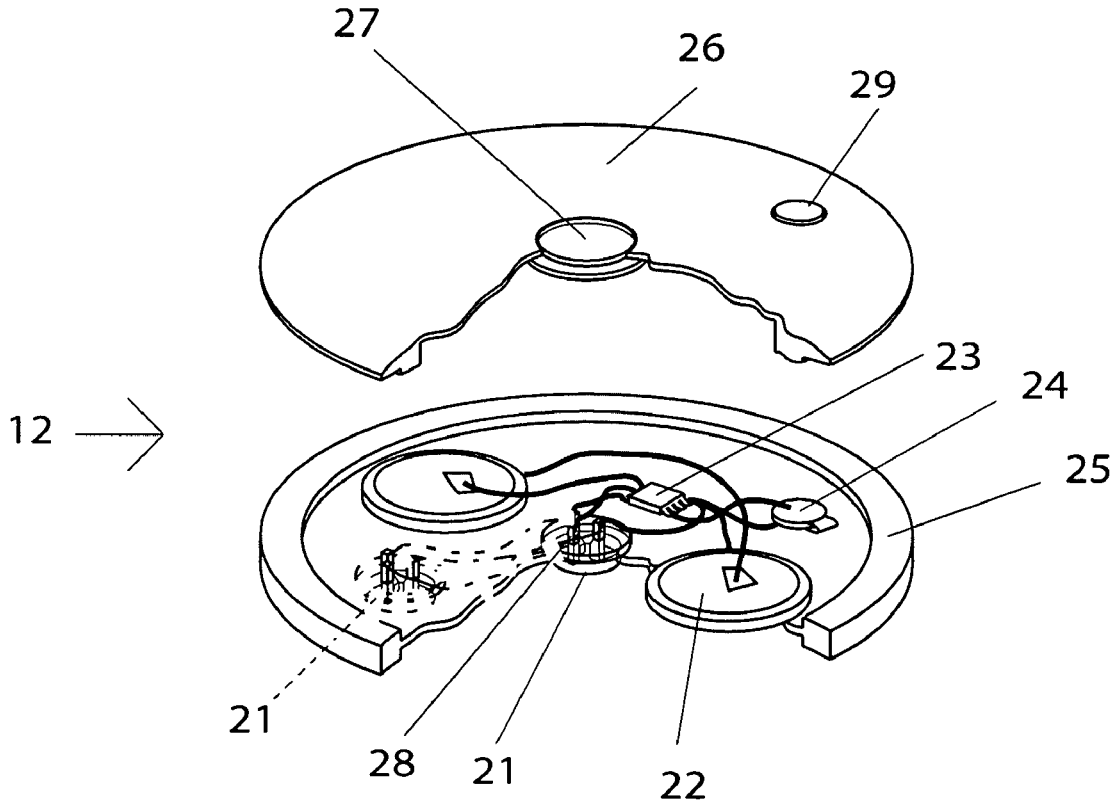
FIG. 6 details one version of an energy emitting game element.

Now referring to FIG. 6, one design for an energy emitting game element 12 utilizes an energy emitting source 21 which is operatively connected to power source 22, such as a battery, a rechargeable battery or a capacitor. A control means 23 comprising a suitably programmed microcontroller, microprocessor or ASIC (application specific I.C.) may be provided to regulate the energy from power source, 22. A switch 24 with push button 29 may be employed to permit the device to be turned on and off as may be desired, though this function can also be afforded automatically by motion sensing means and the like. Puck 25 may be formed of plastic or any other suitable material. The puck need not be shaped as illustrated here but may also take the form of a cylinder, ball or any other shape as may be desired. A lid 27 may be attached to puck 25 so as to conceal energy emitting source 21 and other items as may be desired. A window 27 may be incorporated into lid 26 so that a portion of energy emitted by energy emitting source 21 is detectable at the upper surface of puck 25. Said window may be reactive to the energy emitted by energy emitting source 21. For example, if energy emitting source 21 emits ultraviolet light, then window 27 may employ fluorescers so that a highly visible light is produced on the upper surface of energy emitting game element 12. Additionally, an energy sensor 28 may be employed to detect those regions of reactive surface 11 which have been activated. Signals provided by energy sensor 28 can be employed to synchronize the energization of energy emitting source 21 relative to its position to excited portions of reactive surface 11. Such a scheme is useful for proper generation of complex graphic patterns such as those illustrated in FIGS. 4 and 5. Additionally, such a sensor would permit the determination of passage by energy emitting game element 12 over an energized portion of reactive surface 11 so that a "boundary" line might be sensed.

While a preferred embodiment of the invention has been illustrated and described herein, it is to be understood that variations may be made to the device without departing from the spirit and scope of the invention. It is further understood that the product of the instant invention can be used in any number of other ways and that the exact applications are not limited to those illustrated here.

The invention claimed is:

1. A method for displaying the track of a game article moving on a play surface, said method comprising the steps of:

providing an energy reactive material at said play surface;

incorporating at least one energy emitting source in said game article;

moving said game article on said play surface; and during movement of said game article on said play surface, employing said at least one energy emitting source to energize said energy reactive material to alter the appearance of said play surface and provide a visually observable track display at said play surface indicative of at least a portion of the path taken by said game article on said play surface.

2. The method according to claim 1 wherein photoluminescent energy reactive material is provided at said play surface to provide a luminescent visually observable track display.

3. The method according to claim 1 wherein photochromic energy reactive material is provided at said play surface to provide a visually observable track display having a color differing from the color or colors of the play surface not exposed to energy from said energy emitting source.

4. The method according to claim 1 wherein said at lest one energy emitting source directs energy in a downward direction toward said play surface.

5. The method according to claim 1 wherein said at least one energy emitting source is continuously operative during movement of said game article on said play surface to provide a continuous visually observable track display.

6. The method according to claim 1 wherein said at least one energy emitting source is discontinuously operative during movement of said game article on said play surface to provide a discontinuous visually observable track display.

7. The method according to claim 1 wherein said at least one energy emitting source is substantially centered on said game article and employed to provide a visually observable track display indicative of linear movement of said game article.

8. The method according to claim 1 wherein said game article has a center of rotation and wherein said at lest one energy emitting source is not coincident with the center of rotation of said game article to provide a non-linear visually observable track display during rotation of said game article.

9. The method according to claim 1 wherein said energy reactive material is employed at selected locations at said play surface.

10. The method according to claim 9 wherein said energy reactive material at said selected locations is employed to provide a graphic display of predetermined character at said play surface caused by energization by said at least one energy emitting source during movement of said game article on said play surface.

11. Apparatus comprising, in combination:

a play surface including an energy reactive material; and a game article positioned on said play surface, said game article having at least one energy emitting source, said at least one energy emitting source during movement of said game article on said play surface operable to energize said energy reactive material to alter the appearance of said play surface and provide a visually observable track display at said play surface indicative of at least a portion of the path taken by said game article on said play surface.

12. The combination according to claim 11 wherein said energy reactive material is photoluminescent energy reactive material for providing a luminescent visually observable track display.

13. The combination according to claim 11 wherein said energy reactive material is photochromic energy reactive material for providing a visually observable track display having a color differing from the color or colors of the play surface not exposed to energy from said energy emitting source.

14. The apparatus according to claim 11 wherein said at least one energy emitting source is positioned to direct energy in a downward direction toward said play surface.

15. The apparatus according to claim 11 wherein said game article has a center of rotation and wherein said energy emitting source is located substantially coincident with said center of rotation and operable to provide a visually observable track display indicative of linear movement of said game article.

16. The apparatus according to claim 11 wherein said game article has a center of rotation and wherein said at least one energy emitting source is offset from said center of rotation for providing a visually observable, non-linear track display during rotation of said game article.

17. The apparatus according to claim 11 wherein said energy emitting source is an LED.

18. The apparatus according to claim 11 wherein said energy reactive material is employed at selected locations at said play surface.

19. The apparatus according to claim 18 wherein said energy reactive material at said selected locations is operable to provide a graphic display of predetermined character at said play surface caused by energization of said at least one energy source during movement of said game article on said play surface.

20. A game article for movement on a play surface to provide a visually observable track display at said play surface, said play surface at least partially comprised of energy reactive material, said game article having at least one energy emitting source and a controller for controlling operation of said at least one energy emitting source, said game article having a bottom surface for slidably engaging said play surface during movement thereof on said play surface, said at least one energy emitting source positioned for directing energy in a downward direction toward said play surface when said bottom surface is positioned on said play surface to energize the energy reactive material at said play surface under said game article, said game article additionally including an energy sensor to sense the position of said article on said play surface.

* * * * *